United States Patent [19]

Hill

[11] 4,274,586

[45] Jun. 23, 1981

[54] FLUID SPREADING APPARATUS

[76] Inventor: Francis K. Hill, P.O. Box 259, Wickenburg, Ariz. 85358

[21] Appl. No.: 110,810

[22] Filed: Jan. 10, 1980

[51] Int. Cl.[3] ..... B05B 1/20

[52] U.S. Cl. ..... 239/125; 137/615; 239/168; 239/551; 285/134; 285/184

[58] Field of Search ..... 285/134, 136, 184; 239/124, 125, 166–168, 172, 170, 551, 562; 137/615

[56] References Cited

U.S. PATENT DOCUMENTS

| | | | |
|---|---|---|---|
| 1,297,135 | 3/1919 | Fricker | 239/551 |
| 2,579,792 | 12/1951 | Cartwright | 239/551 |
| 3,838,817 | 10/1974 | Hill | 239/168 X |

*Primary Examiner*—Andres Kashnikow
*Attorney, Agent, or Firm*—Herbert E. Haynes, Jr.

[57] ABSTRACT

A vehicle mounted fluid spreading apparatus including a fixed spray bar having an extender spray bar mounted on each of the opposite ends thereof by means of swing joints so that each of the extender spray bars are movable about a single angularly disposed axis between extended and stowed positions. The spray bars and the swing joints have dual fluid flow passages formed therethrough so that fluid under pressure from a fluid supply is serially recirculated through the spray bars and swing joints back to the fluid supply when the apparatus is in a standby mode, and is sprayingly applied by actuator controlled self-adjusting nozzles mounted in the spray bars when the apparatus is in the operating mode.

8 Claims, 8 Drawing Figures

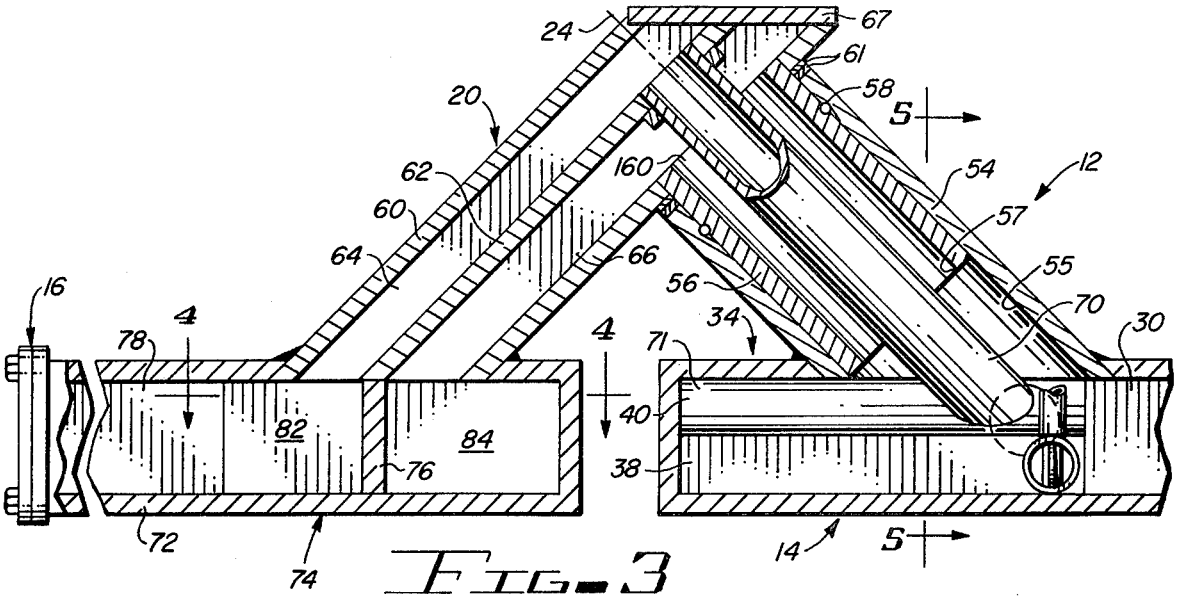
FIG. 3
FIG. 4
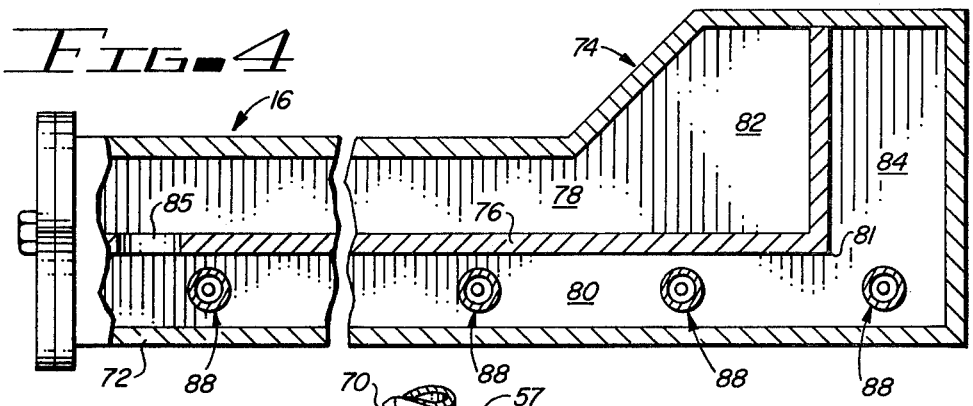
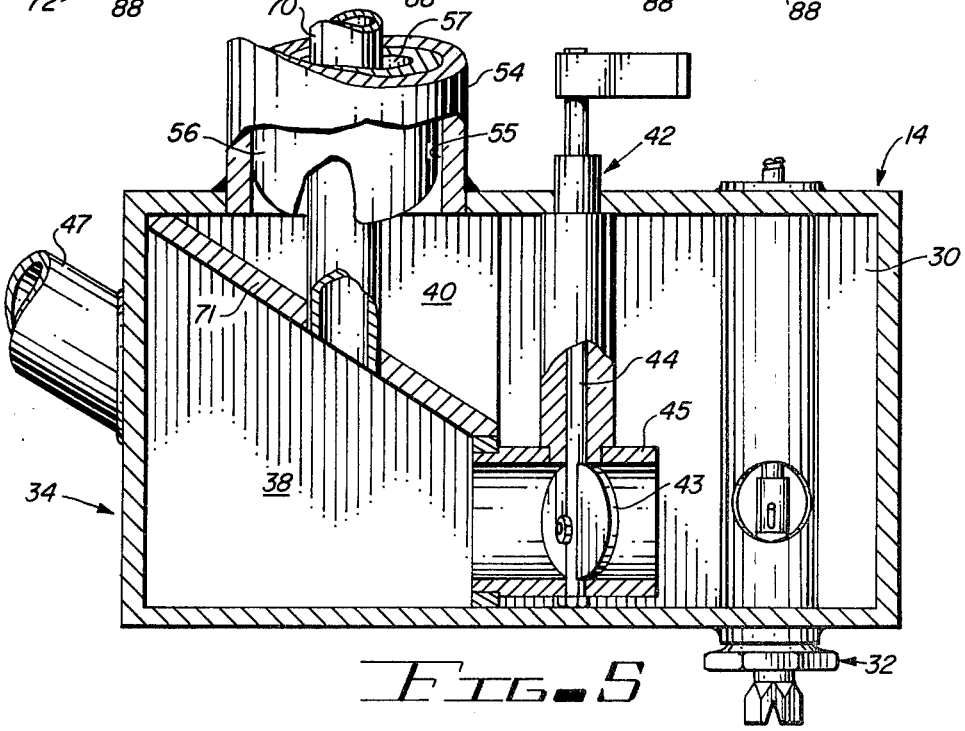
FIG. 5

FLUID SPREADING APPARATUS

BACKGROUND OF THE INVENTION

1. Field of the Invention

This invention relates to fluid spreading devices and more particularly to a vehicle carried fluid spreader apparatus having multiple spray bars at least one of which is swingingly movable about a single angularly disposed axis between extended and stowed positions.

2. Description of the Prior Art

In the spreading of fluids, such as hot asphalt on roadways, a tank truck is often used, with the truck having a substantially fixed centrally located spray bar extending across the rear of the truck.

Due to Federal and regional laws, the legal width of a highway operated motor vehicle is limited, and this sets the maximum length of the fixed centrally located spray bar. To increase the fluid spray path beyond that which can be achieved by the fixed centrally located spray bar, a pair of extender spray bars are often mounted on the opposite ends of the fixed spray bar, and those extender spray bars are movable between extended and stowed positions. In addition to conforming to the legal width restrictions, the extender spray bars must be movable so as to avoid damage to the extender spray bars and/or to any obstructions that may, and oftentimes are, encountered during the operation of such spraying equipment.

When spreading fluid materials such as hot asphalt, it is advantageous to provide for recirculation of the fluid through the spray bars and back to the fluid supply tank to maintain the molten state of the fluid when the apparatus is not spreading the fluid, such as when the truck is being driven to or between job sites, refilling of the supply tank, and other standby operating modes. Explaining further, when hot asphalt is being applied, it is heated in the tank of the truck and pumped to the spray bars. If the hot asphalt cools in the spray bars during a standby operating mode, it will become less fluid and will clog the apparatus. When this occurs, a very messy and time consuming clean-up operation must be accomplished, which usually involves circulatingly flushing the entire system with a suitable solvent.

A particular prior art device is fully disclosed in U.S. Pat. No. 3,838,817, issued on Oct. 4, 1974 to the same inventor. Briefly, this prior art device includes an elongated substantially fixed, i.e., non-swinging, spray bar carried transversely on the back of a spreader tank truck with extender spray bars movably mounted on the opposite ends thereof by swing joints. Each of the extender spray bars is mounted on a double swing joint arrangement so that it is movable about both a horizontal axis and a vertical axis to accomplish the desired movement between the extended and stowed positions. The swing joints and the spray bars are provided with dual fluid flow paths so that the fluid delivered under pressure from the supply tank may be serially and recirculatingly supplied to the spray bars and returned to the supply tank to maintain the molten state of the fluids during standby operating modes. The fixed spray bar and the extender spray bars are provided with spacedly arranged nozzles for sprayingly applying the fluids and the nozzles are controlled by suitable linear actuators. The nozzles in the fixed spray bar are ganged for simultaneous operation and are controlled by a linear actuator, and the nozzles in the extender spray bars are similarly ganged and under the control of separate linear actuators. In this manner, the nozzles in the fixed spray bar and the nozzles in the extender spray bars may be independently or simultaneously operated.

The normal fluid flow path in this prior art structure is such that the fluid is directed through the extender spray bar to the fixed spray bar. However, the apparatus is provided with means whereby the fluid is concurrently supplied to the extender spray bar and fixed spray bar to insure that a sufficient quantity of the fluid is supplied directly to the fixed spray bar during the operating mode of the apparatus.

The above described prior art device is a substantial improvement in the art, however, a few shortcomings and drawbacks exist in that apparatus. In the first place, the double swing joint arrangement for mounting of the extender spray bars are very costly and rather bulky devices. And, the dual fluid flow passages formed in those multiple swing joints and the associated conduits thereof are quite long and this dual passage length contributes to the cooling and solidification tendencies of the fluid materials. Another drawback of this particular prior art device concerns the ganged interconnection of the fluid spray nozzles. The ganged nozzles must be so arranged that they open and close simultaneously under the control of the linear actuator, and this involves a rather complex and time consuming precision adjustment procedure to insure that no leakage occurs when the nozzles are in the closed position.

Therefore, a need exists for a new and improved fluid spreading apparatus which overcomes some of the shortcomings of the prior art.

SUMMARY OF THE INVENTION

In accordance with the present invention a new and improved fluid spreading apparatus is disclosed as including a non-swinging or fixed spray bar carried transversely on the back of a tank truck, and at least one extender spray bar movably mounted on the end of the fixed spray bar. The extender spray bar is mounted on a single acting swing joint which is configured so that the extender spray bar is movable about an angularly disposed axis between the extended and stowed positions thereof. Fluid, such as hot asphalt, is pumped from the supply tank on the truck so that it is serially recirculated through the dual fluid flow passages formed through the spray bars and swing joint and return to the supply tank to maintain the molten state of the fluid during standby modes of the apparatus.

The single acting swing joint mounting arrangement of the extender bar results in considerable reductions in the cost, bulk, and complexity of the apparatus of the present invention, and reduces the tendency of the fluid to cool and solidify by shortening of the length of the dual fluid flow passages formed through the apparatus.

During the operating modes of the apparatus, the fluid is similarly supplied to the spray bars and is spreadingly applied by a plurality of spray nozzles which are spacedly arranged along the lengths of the spray bars. As in the prior art apparatus hereinbefore described, the present apparatus is provided with means for optionally directing the fluid concurrently to the extender and fixed spray bars during the operating mode of the apparatus to insure that a sufficient quantity of the fluid is supplied to all of the spray bars.

The nozzles of the fixed spray bar are interconnected for ganged operation and are under control of a suitable linear actuator, and likewise, the nozzles of the extender spray bar are similarly ganged and are under the control of different linear actuators. In this manner, the nozzles of the different spray bars may be simultaneously or individually operated. The spray nozzles are each especially configured to include a spring-loaded axially slidable ball valve assembly which provides the nozzles with a self-adjusting feature.

The ganged operation of the fluid spray nozzles requires that each of these nozzles are properly seated when they are actuated to the closed position to insure against fluid leakage during the standby mode. In the hereinbefore described prior art apparatus, insuring against such leakage required precision and time consuming adjustments to each of the nozzles and such adjustment requirements are considerably facilitated in the improved apparatus of the present invention due to the self-adjusting feature provided by the spring-loaded ball valves of the multiple spray nozzles.

Accordingly, it is an object of the present invention to provide a new and improved fluid spreading apparatus of the type carried transversely on the back of a tank truck.

Another object of the present invention is to provide a new and improved fluid spreading apparatus of the above described type which includes a substantially fixed centrally located fluid spray bar extending across the back of the tank truck and at least one extender spray bar mounted on the end of the fixed spray bar to widen the spray path of the apparatus beyond the width of the truck, with the extender spray bar being mounted so as to be movable between extended and stowed positions for clearing obctacles that may be encountered during spraying operations.

Another object of the present invention is to provide a new and improved fluid spreading apparatus of the above described type wherein the extender spray bar is movably mounted on a single acting swing joint for movement about an angularly disposed axis.

Another object of the present invention is to provide a new and improved fluid spreading apparatus of the above described character in which the spray bars and single acting swing joint have dual fluid flow passages formed therethrough so that the fluid may be recirculated during standby operating modes of the apparatus and may be delivered to a plurality of spray nozzles mounted in the spray bars during fluid spreading operating modes.

Still another object of the present invention is to provide a new and improved fluid spreading apparatus of the above described character in which the spray nozzles are controlled by suitable linear actuators and are interconnected for ganged operation with each of the nozzles being a self-adjusting device which insures positive seating of the multiple spray nozzles.

The foregoing and other objects of the present invention as well as the invention itself may be more fully understood from the following description when read in conjunction with the accompanying drawings.

BRIEF DESCRIPTION OF THE DRAWINGS

FIG. 3 is an enlarged fragmentary sectional view taken along the line 3—3 of FIG. 2.

FIG. 4 is an enlarged fragmentary sectional view taken along the line 4—4 of FIG. 3.

FIG. 5 is an enlarged fragmentary sectional view taken along the line 5—5 of FIG. 3.

DESCRIPTION OF THE PREFERRED EMBODIMENT

Figures 1, 2:
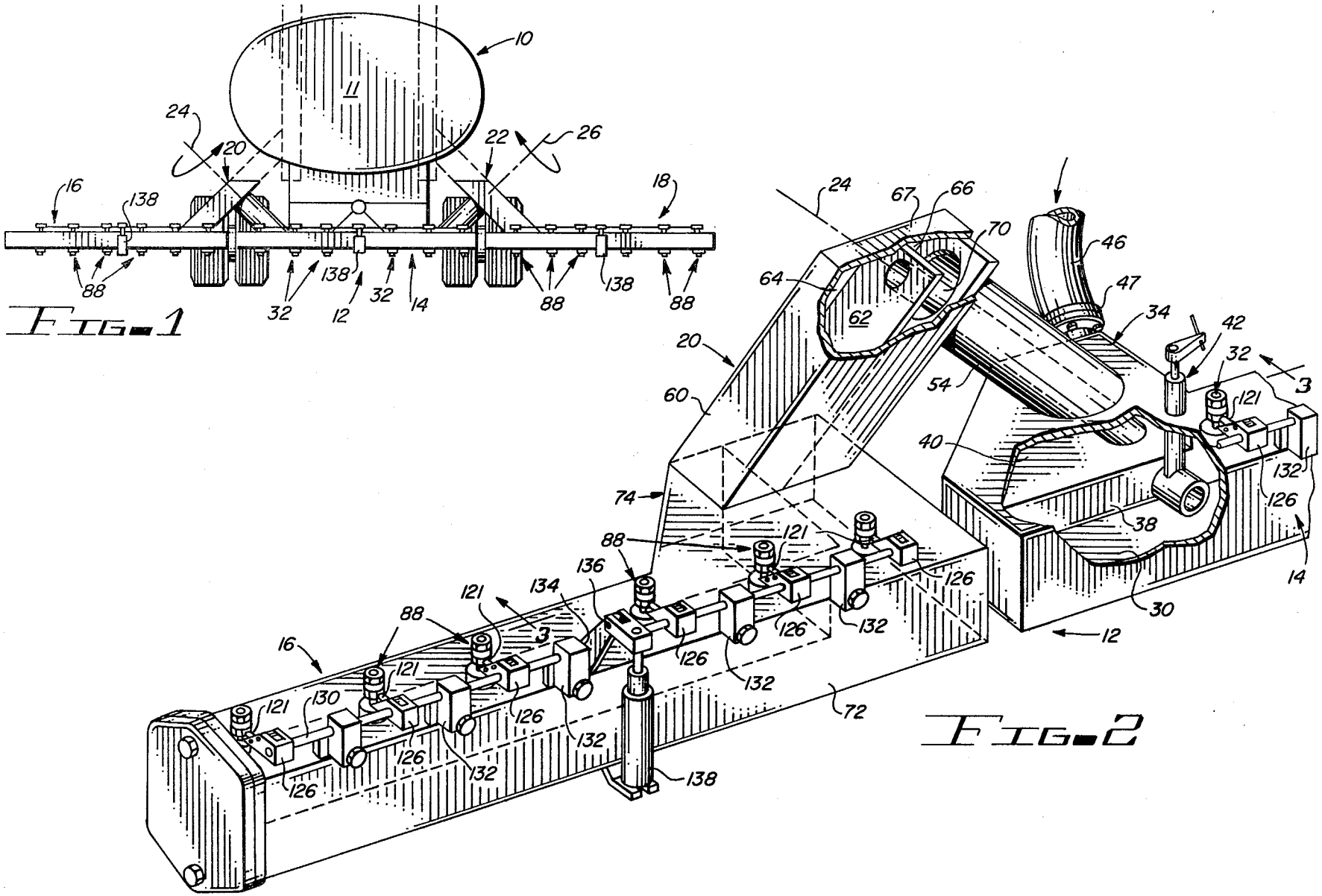
FIG. 1 is a rear elevational view of a tank truck with the improved fluid spreader apparatus mounted thereon, with this view being in simplified form to illustrate the component relationships and relative movements of the apparatus.
FIG. 2 is an enlarged fragmentary perspective view of the left side of the fluid spreader apparatus, with portions thereof broken away to illustrate the various features thereof.

Referring more particularly to the drawings, FIG. 1 illustrates a typical tank truck 10 having a fluid supply tank 11 mounted thereon, and having the fluid spreading apparatus of the present invention carried on the rear of the truck, with the fluid spreading apparatus being indicated generally by the reference numeral 12. Although not shown, the tank truck 10 is equipped with suitable fluid heating devices, and associated equipment, and as will hereinafter be described, suitable pumps, control valves and other necessary devices are provided on the truck for delivering hot fluid under pressure, such as asphalt, to the apparatus 12.

As will hereinafter be described in detail, the fluid spreading apparatus 12 includes an elongated hollow central spray bar 14 which is secured in a substantially fixed position relative to the truck 10, and extends in a horizontal attitude transversely across the rear of the truck. An identical pair of oppositely disposed elongated hollow wing, or extender spray bars 16 and 18 are mounted on the opposite ends of the fixed central spray bar 14 by means of swing joint 20 and 22. As seen in solid lines in FIG. 1, the extender spray bars 16 and 18 protrude laterally beyond the opposite sides of the truck and are in axial alignment with the fixed center spray bar 14, with such positioning constituting the operative extending positions of the extender spray bars. In the same Figure, the dash line positions of the extender spray bars 16 and 18 illustrate the stowed positions as being upright on opposite sides of the truck at substantially right angles with respect to the fixed center spray bar 14. Movements between the extended and stowed positions are accomplished by rotating the extender spray bars through an arc of approximately 180° about the angularly disposed axes 24 and 26 which lie on the center lines of the swing joints 20 and 22, respectively. It is to be understood that movement of the extender spray bars 16 and 18 may be accomplished by any suitable means such as hydraulic, electric, pneumatic, or other power operated devices (not shown), may be accomplished by mechanically actuated linkages (not shown), or may simply be moved manually.

The fixed central spray bar 14 is an elongated hollow box beam structure which is closed at its opposite ends and defines a single fluid flow passage 30 which extends longitudinally therein. As will hereinafter be described, a plurality of fluid spray nozzles 32 are mounted in spaced increments along the length of the center fixed spray bar 14 and are disposed to be in communication with the fluid passage 30. Each of the opposite ends of the fixed spray bar 14 is formed with an enlarged fluid directing compartment, with the compartment 34 on the left hand end being shown in detail in FIGS. 2, 3 and 5, and the compartment 36 formed on the right hand end being shown diagrammatically in FIG. 8. The fluid directing compartments are identical, therefore, the following description of the compartment 34 will be understood to also apply to the compartment 36.

The fluid directing compartment 34 is divided into a closed lower chamber 38 and an upper chamber 40 which is open so as to be in direct communication with the longitudinal fluid passage 30 formed through the fixed spray bar 14. As will hereinafter be described, both the closed lower chamber 38 and the open upper chamber 40 are in communication with different portions of the swing joint 20, and a suitably actuated shutoff valve 42 is disposed so as to couple the closed lower chamber 38 to the fluid passage 30, with the valve 42 allowing optional communication to be established therebetween. The shutoff valve 42 may be any suitable structure such as that shown best in FIG. 5 as including a closure disc 43 fixed to rotate with the shaft 44 between open and closed positions in the bore of a conduit 45. The normally closed lower chamber 38 of the fluid directing compartment 34 is coupled to the tank 11 of the truck 10 such as by a suitable conduit or hose 46, that is connected to a flange 47 provided on the compartment for that purpose.

Figure 8:
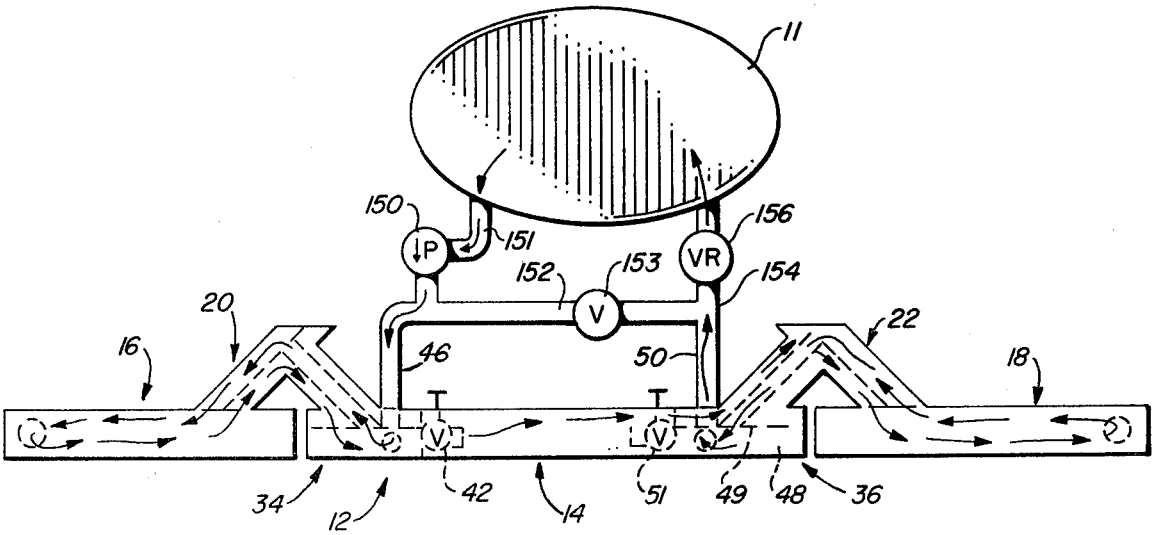
FIG. 8 is a diagrammatic view of the apparatus of the present invention and illustrates the fluid flow through the apparatus during the standby mode thereof.

The other fluid directing compartment 36, as shown diagrammatically in FIG. 8, has the identical components of a lower closed chamber 48, an upper open chamber 49, a conduit or hose 50 for coupling the chamber 48 to the tank 11, a shutoff valve 51, and the compartment 36 is in communication with the swing joint 22.

The extender spray bars 16 and 18 and their respective swing joints 20 and 22 are identical, therefore, the following description of the extender spray bar 16 and swing joint 20 will be understood to also apply to the spray bar 18 and swing joint 22.

As seen best in FIGS. 2 and 3, the swing joint 20 includes a hollow cylindrical support collar 54 having a bore 55, with the collar being suitably attached such as by welding, to the upper surface of the central spray bar 14 immediately above the fluid directing compartment 34. The support collar 54 is disposed so as to be concentric with the swing joint axis 24, and therefore, extends angularly upwardly and outwardly with respect to the fixed central spray bar 14 at an angle of approximately 45°. A hollow cylindrical sleeve 56 having an axial bore 57, is concentrically mounted in the bore 55 of the support collar 54, and is rotatable about the swing joint axis 24. A suitable O-ring seal 58 is interposed between the collar 54 and the sleeve 56 to provide a fluid tight seal therebetween. The sleeve 56 is axially positioned in the collar 54 so that its upper end extends beyond the upper end of the collar 54 and is fixedly attached, such as by welding, to the lower surface of an elongated arm 60 so that the arm 60 and the sleeve 56 are rotatable as an entity about the swing joint axis 24. Friction washers 61 are interposed between the lower surface of the arm 60 and the upper end of the support collar 54 to facilitate the rotational movement. The elongated arm 60 is hollow and is divided by a partition 62 into an upper channel or passage 64 and a lower channel or passage 66, both of which extend longitudinally through the arm 60 which has one of its ends closed by a suitable plate 67, with its other end attached to the extender spray bar 16 as will hereinafter be described in detail. The sleeve 56 is affixed to the elongated arm 60 adjacent its closed end so tat an approximate 90° relationship exists therebetween, and the axial bore 57 of the sleeve 56 is in communication with the lower passage 66 of the arm 60, and is in communication with the open upper chamber 40 which forms part of the fluid directing compartment 34 of the fixed center spray bar 14. A tubular conduit 70 of reduced diameter is coaxially disposed in the sleeve 56 with its upper end connected to the partition 62 of the elongated arm 60, in a manner which allows the arm 60 to rotate about the conduit, and its lower end affixed to the angularly disposed roof 71 of the lower chamber 38 which forms the other part of the fluid directing compartment 34 of the central spray bar 14. Thus, the tubular conduit 70 is stationary and is in communication with the closed lower chamber 38 of the fluid directing compartment 34 and is also in communication with the upper passage 64 of the elongated arm 60.

As seen best in FIGS. 3 and 4, the extender spray bar 16 includes an elongated box beam housing 72 which is closed at its opposite ends and is provided with an enlarged fluid channeling compartment 74 at the end thereof which is proximate the end of the fixed center spray bar 14. The extender spray bar 16 is divided by a partition 76 into a first fluid passage 78 and a second fluid passage 80, and that same partition 76 is formed as at 81 into a 90° bend so that it extends into the fluid channeling compartment 74 and divides it into a first chamber 82 and a second chamber 84. As shown best in FIG. 4, the first fluid passage 78 of the extender spray bar 16 is in direct communication with the first chamber 82 of the fluid channeling compartment 74, and the second fluid passage 80 is in direct communication with the second chamber 84 thereof. The partition 76 of the extender spray bar 16 is provided with an opening 85 formed therethrough so that the first and second fluid passages 78 and 80 are in communication with each other at a point proximate the extending end of the extender spray bar 16.

The elongated arm 60 of the swing joint 20 is attached to the extender spray bar 16 as hereinbefore mentioned, with such attachment being accomplished in any suitable manner, such as by welding. The elongated axis of the arm 60 is in approximately a 45° angular relationship with respect to the longitudinal axis of the extender spray bar 16, and is disposed so that the upper passage 64 of the arm 60 is in communication with the first chamber 82 of the fluid channeling compartment 74, and the lower passage 66 of the arm 60 is in communication with the second chamber 84 of the fluid channeling compartment 74. As will hereinafter be described in detail the extender spray bar 16 is provided with a plurality of fluid spray nozzles 88 mounted in spaced increments along the length thereof.

As hereinbefore mentioned, the fixed central spray bar 14 has a plurality of fluid spray nozzles 32 mounted thereon, and the extender spray bars 16 and 18 are provided with a plurality of fluid spray nozzles 88. The spray nozzles 32 and 88 are identical structures, and the following description of a typical one thereof will be understood to apply to all the nozzles.

Figure 6:
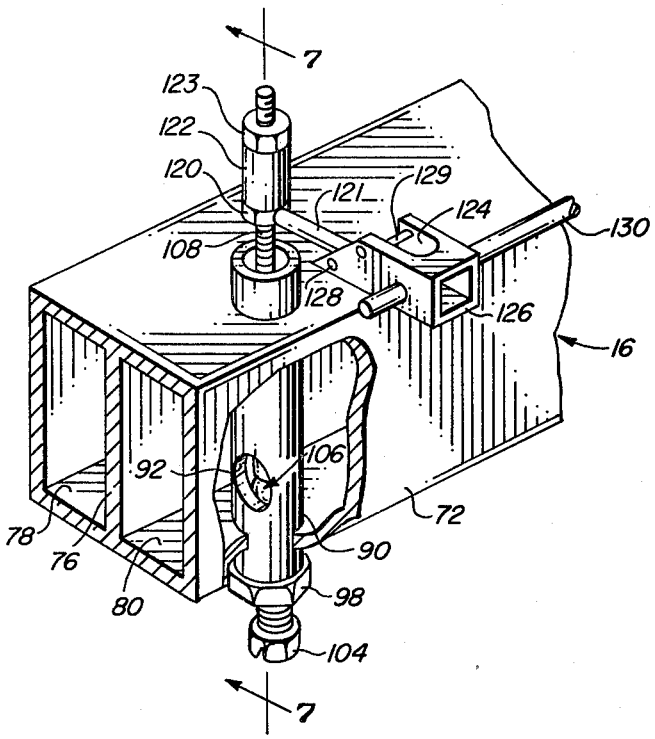
FIG. 6 is a fragmentary perspective view which is partially broken away to illustrate a typical one of the plurality of self-adjusting fluid spray nozzles mounted in the spray bars of the apparatus of the present invention.
Figure 7:
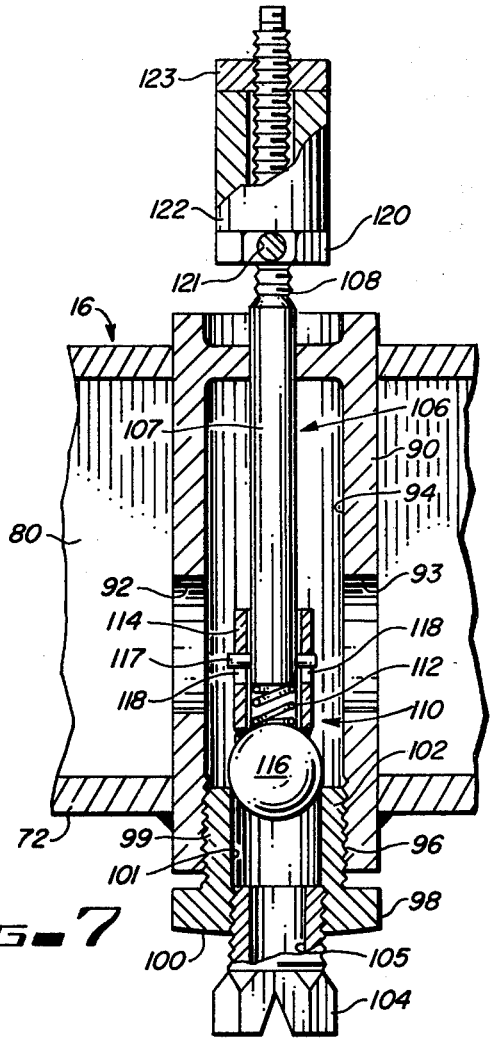
FIG. 7 is an enlarged fragmentary sectional view taken along the line 7—7 of FIG. 6.

As seen in FIGS. 6 and 7, the typical fluid spray nozzle 88 includes a hollow elongated cylindrical valve body 90 which is mounted in the extender spray bar housing 72 so as to pass vertically through the second fluid passage 80 thereof and is sealingly secured in the top and bottom walls of the housing. The valve body 90 has at least a pair of relatively large openings 92 and 93 formed in its sides so that fluid moving in the second passage 80 of the extender spray bar 16 is free to flow into the bore 94 of the valve body. The depending end of the valve body 90 extends below the bottom wall of the housing 72 and is internally threaded as at 96 to sealingly receive a plug 98 therein. The plug 98 is provided with an externally threaded shank portion 99 and a head portion 100 in the form of a nut. An axial bore 101 is drilled or otherwise formed through the plug 98, with the upwardly disposed end of the shank 99 which circumscribes the axial bore 101 serving as a valve seat 102, and with the downwardly disposed end of the axial bore 101 being internally threaded to sealingly receive an orifice plug 104 which has an axial bore 105 formed therethrough. A slide valve 106 is mounted in the body 90, and is axially movable in the bore 94 thereof. The slide valve 106 includes an elongated valve stem 107 having its upper end threaded as at 108 with the upper end extending axially beyond the body 90. A valve head assembly 110 is mounted on the other end of the valve stem 107 for movement with the stem into and out of seated engagement with the valve seat 102. In addition to movement with the valve stem 107, the valve head assembly 110 is axially movable relative to the stem and is biasingly urged toward the valve seat 102 by means of a compression spring 112. The valve head assembly 110 includes a tubular sleeve 114 which is concentrically and slidably mounted on the end of the valve stem 107, with a ball 116 or other suitably configured head, welded or otherwise affixed to the extending end of the tubular sleeve 114. The valve head assembly 110 is captively retained on the end of the valve stem 107, and its axial slidable movement is limited by, a pin 117 which is transversely carried in the end of the valve stem 107 so that each of its oppositely extending ends are positioned in a different one of a pair of elongated slots 118 that are formed in diametrically opposed sides of the tubular sleeve 114. The compression spring 112 is positioned in the tubular sleeve 114 so as to bear against the end of the valve stem 107, and to bear against the ball 116.

A nut 120, having a pin 121 affixed thereto so as to extend outwardly from one of its sides, is screwed onto the threaded upper end 108 of the valve stem 107. A spacer sleeve 122 is concentrically positioned on the stem 107 above the nut 120, and a lock nut 123 is screwed tight against the top of the spacer sleeve 122 to lock it and the nut 120 in the desired position on the valve stem. As seen best in FIG. 6, the pin 121 is received in a cutout 124 formed in a connecting block 126, with a pair of vertically spaced pins 128 and 129 extending across the cutout 124 and in engagement with the top and bottom surfaces of the pin 121.

Referring now to FIG. 2 wherein it is seen that each of the fluid spray nozzles 88 on the extender spray bar 16, is provided with an extending pin 121 for engagement with different connecting blocks 126, and the plurality of the blocks 126 are fixedly carried on a common shaft 130 that is journaled for rotation in bearing blocks 132 mounted in spaced increments along the length of the extender spray bar 16. A lever 134 fixedly carried on the shaft 130 extends therefrom into engagement with a connecting block 136, with this connecting block being similar to the previously described blocks 126, and the connecting block 136 is carried on that extensible rod end of a linear actuator 138. The linear actuator may be a hydraulic ram, electric solonoid, or th like. The interconnection between the extensible rod and the linear actuator 138 and the shaft 130 is such that when the actuator is in its normaly extended state, the shaft 130 is rotated to push the valve stems 107 down to close the fluid spray nozzles 88. Likewise, when the linear actuator 138 is suitably energized to move it to its retracted state, the shaft is oppositely rotated and will thus lift the valve stems 107 to open the fluid spray nozzles 88.

The purpose of the spring biased axially movable valve head assemblies 110 of the fluid spray nozzles 88 will now be seen as a means for seating all of the valve heads of the gang operated fluid spray nozzles 88. Due to the ganged operation, all of the nozzles 88 must move to the seated closed position with a fixed amount of rotation of the common shaft 130. In the absence of the axially slidable valve head assemblies 110, such seating is extremely difficult to accomplish in that precise adjustment of each nozzle is required to obtain absolute simultaneous valve seating. With the spring biased axially slidable valve head assemblies 110, the need for absolute simultaneous seating is eliminated in that premature seating of one or more of the valve head assemblies 110 will not stop the rotation of the common shaft 130, and such rotation will continue until all of the assemblies 110 have been seated.

It will be understood that although all of the fluid spray nozzles 88 carried on the extender spray bar 16 are shown as being gang operated by a single linear actuator 138, the nozzles can be ganged into smaller groups each under the control of a separate actuator. Further, it will be understood that all of the fluid spray nozzles 32 and 88 of the fluid spreading apparatus 12 are configured and operated in the above described manner.

Although operation of the fluid spreading apparatus 12 of the present invention may be obvious from the above detailed description, operational descriptions will now be given to insure a complete understanding thereof.

FLUID RECIRCULATION OPERATING MODE

As seen in FIG. 8, a suitable pump 150 is connected by means of a conduit 151 to the fluid outlet of the tank 11 for drawing fluid from the tank and pumping it under pressure into the hose 46, and through another conduit 152, having a shutoff valve 153 therein, into the hose 50. A conduit 154 having a pressure regulating valve 156 therein is connected between the hose 50 and the fluid return port of the tank 11.

FIG. 8 shows the fluid flow through the apparatus 12 when it is in the fluid recirculating mode. In this mode, the valves 42, 51 and 153 are closed so that the fluid will circulate from the tank serially through the various spray bars and back into the tank, and fluid will not be sprayed by the apparatus 12. Fluid under pressure from the pump 150 is directed via the hose 46 into the closed lower chamber 38 of the fluid directing compartment 34. That fluid will pass through the conduit 70 of the swing joint 20 into the upper passage 64 of the arm 60, into the first chamber 82 of the fluid channeling compartment 74. The fluid will move through the first chamber 82 into the first fluid passage 78 of the extender spray bar 16, and will pass through the opening 85 into the second fluid passage 80 of the spray bar. From the second fluid passage 80, the fluid passes through the second chamber 84 of the fluid channeling compartment 74 into the lower passage 66 of the arm. From there, the fluid passes through the annular passage 160 between the sleeve 56 and the conduit 70 of the swing joint 20 and into the open upper chamber 40 of the fluid directing compartment 34. The fluid under pressure will now move through the single fluid passage 30 of the fixed center spray bar 14 toward the opposite end thereof. Upon reaching the fluid directing compartment 36, the fluid will pass through the open compartment 49 thereof, through the swing joint 22 into the lower passage 66 of the arm 60, and moves serially through the second fluid passage 80, the opening 85, and the first fluid passage 78 of the extender spray bar 18. The fluid then moves through the upper passage 64 of the arm 60 into the conduit 70, into the normally closed lower chamber 48 of the fluid directing compartment 36, and will pass therethrough into the hose 50 through the regulating valve 156, conduit 154, and back to the tank 11.

The above described fluid recirculating mode of the apparatus is employed when the apparatus 12 is in the standby state so that the fluid, i.e., hot asphalt will not stand in any part of the apparatus and thus will not be allowed to cool and solidify,

FLUID SPREADING OPERATIONAL MODE

To spread fluid, the pressure regulating valve 156 is adjusted to a fairly high pressure rating which restricts the fluid return to the tank 11. The valve 153 is opened so that the fluid under pressure will be supplied in substantially equal quantities and pressures through the hoses 46 and 50 to the lower chambers 38 and 48 of the fluid directing compartments 34 and 36, respectively. The valve 42 is also opened so that the fluid in the fluid directing compartment 34 will be directed in substantially equal quantities and pressures to both the extender spray bar 16 and to the left hand end, as viewed in FIG. 8, of the central spray bar 14. Likewise, the valve 51 is opened so that the fluid in the fluid directing compartment 36 will be directed in substantially equal quantities and pressures to both the extender spray bar 18 and the right hand side, as viewed in FIG. 8, of the central spray bar 14. With the linear actuators 138 energized to open the fluid spray nozzles 32 and 88, the fluid under pressure supplied to the spray bars 14, 16 and 18 in the above described manner will be sprayingly applied to an underlying surface such as a roadway.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A fluid spreading apparatus for mounting on a fluid carrying vehicle comprising:

(a) a fixed spray bar having a fluid flow passage therein and mountable transversely on the rear of the vehicle;

(b) an extender spray bar adjacent one end of said fixed spray bar and having a fluid flow passage therein;

(c) a swing jont having a stationary portion mounted on said fixed spray bar and defining an axis which extends angularly upwardly and outwardly from the one end of said fixed spray bar and having a swing portion mounted for rotation about said axis, said extender spray bar mounted on the swing portion for rotation therewith between an operating position where said extender spray bar is axially aligned with said fixed spray bar and an upright stowed position where said extender spray bar is at substantially a right angle with respect to said fixed spray bar, said swing joint having a first fluid flow passage extending therethrough which is in communication with one end of the fluid flow passage of said extender spray bar and having a second fluid flow passage extending therethrough which is in communication with the other end of the fluid flow passage of said extender spray bar;

(d) fluid direciting means on one end of said fixed spray bar and having a first chamber connectable to receive fluid under pressure from the vehicle and in communication with the first fluid flow passage of said swing joint and having a second chamber which is in communication with the second fluid flow passage of said swing joint and in communication with the fluid flow passage of said fixed spray bar; and (e) valve means forming a fluid flow passage between the first chamber of said fluid directing means and the fluid flow passage of said fixed spray bar and optionally operable between open and closed positions.

2. A fluid spreading apparatus as claimed in claim 1 wherein said swing joint comprises:

(a) a collar of elongated cylindrical configuration mounted fast on said fixed spray bar so as to extend angularly upwardly and outwardly from the one end thereof, said collar having a bore extending therethrough;

(b) a sleeve of elongated cylindrical configuration concentrically disposed in the bore of said collar and journaled for rotation therein, said sleeve having a bore extending therethrough;

(c) an arm mounted on the upwardly disposed end of said sleeve for rotation therewith, said arm having a partition extending therethrough to divide said arm into first and second channels; and (d) a conduit concentrically disposed in said collar and said sleeve, said conduit naving its bore in communication with the first channel of said arm to cooperatively form the first fluid flow passage of said swing joint, said conduit of reduced diameter to form an annular passage between the periphery of said conduit and the bore of said sleeve with that annular passage being in communication with the second channel of said arm to cooperatively form the second fluid flow passage of said swing joint.

3. A fluid spreading apparatus as claimed in claim 1 and further including at least a pair of fluid spray nozzles mounted on said extender spray bar in spaced apart locations, said fluid spray nozzles in communication with the fluid flow passage of said extender spray bar and selectively operable between open and closed positions.

4. A fluid spreading apparatus as claimed in claim 1 and further including at least a pair of fluid spray nozzles mounted on said fixed spray bar in spaced apart locations, said fluid spray nozzles in communication with the fluid flow passage of said fixed spray bar and selectively operable between open and closed positions.

5. A fluid spreading apparatus as claimed in claim 1 and further comprising:

(a) a second extender spray bar adjacent the opposite end of said fixed spray bar and having a fluid flow passage therein;

(b) a second swing joint having a stationary portion mounted on said fixed spray bar and defining an axis which extends angularly upwardly and outwardly from the opposite end of said fixed spray bar and having a swing portion mounted for rotation about that axis, said second extender spray bar mounted on the swing portion for rotation therewith between an operating position where said second extender spray bar is axially aligned with said fixed spray bar and an upright stowed positon where said second extender spray bar is at a substantially right angle with respect to said fixed spray bar, said second swing joint having a first fluid flow passage extending therethrough which is in communication with one end of the fluid flow passage of said second extender spray bar and having a second fluid flow passage extending therethrough which is in communication with the other end of the fluid flow passage of said second extender spray bar; and (c) second fluid directing means on the opposite end of said fixed spray bar and having a first chamber connectable to the fluid of the vehicle and in communication with the first fluid flow passage of said second swing joint and having a second chamber which is in communication with the second fluid flow passage of said second swing joint and in communication with the fluid flow passage of said fixed spray bar.

6. A fluid spreading apparatus as claimed in claim 5 and further comprising valve means forming a fluid flow passage between the first chamber of said second flow directing means and the fluid flow passage of said fixed spray bar and optionally operable between open and closed positions.

7. A fluid spreading apparatus as claimed in claim 5 and further including at least a pair of fluid spray nozzles mounted on said second extender spray bar in spaced apart locations, said fluid spray nozzles in communication with the fluid flow passage of said second extender spray bar and selectively operable between open and closed positions.

8. A fluid spreading apparatus as claimed in claims 3, 4 or 7 wherein said pair of fluid spray nozzles are ganged for simultaneous operation between the open and closed positions thereof, each of said fluid spray nozzles comprising:

(a) a valve body of hollow elongated configuraton mounted so as to extend through the fluid flow passage of said spray bar, said valve body having at least one opening formed in the side thereof;

(b) a valve seat mounted in one end of said valve body and having a bore formed axially therethrough;

(c) an elongated valve stem axially slidably movable in said valve body and having one end adjacent said valve seat;

(d) a valve head assembly means on the one end of said valve stem and axially movable relative thereto, said valve head assembly including means for biasingly urging said valve head assembly toward said valve seat; and (e) means coupled to the other end of said valve stem for axially slidably moving said valve stem in said valve body.

* * * * *